US006564703B1

(12) United States Patent
Lin

(10) Patent No.: US 6,564,703 B1
(45) Date of Patent: May 20, 2003

(54) STRUCTURE OF CLIP

(76) Inventor: Kun-Meng Lin, No. 44-17, Han Nan Street, Wen Te Village, Hua Tan Hsiang Chang Hua Hsien (TW)

( * ) Notice: Subject to any disclaimer, the term of this patent is extended or adjusted under 35 U.S.C. 154(b) by 0 days.

(21) Appl. No.: 10/151,321

(22) Filed: May 21, 2002

(51) Int. Cl.[7] ..... B30B 7/00; B25B 7/14

(52) U.S. Cl. ..... 100/234; 81/328; 81/391; 269/6

(58) Field of Search ..... 100/219, 234, 100/243; 81/318, 319, 320, 322, 324, 328, 339, 340, 391, 392; 269/6, 212, 215, 238; 30/250, 188, 251

(56) References Cited

U.S. PATENT DOCUMENTS 2,249,661 A * 7/1941 Littlefield ..... 81/328
3,354,759 A * 11/1967 Cook ..... 81/379
5,842,371 A * 12/1998 Liaw ..... 72/409.12
6,199,458 B1 * 3/2001 Wrigley et al. ..... 81/319
6,240,815 B1 * 6/2001 Huang ..... 81/328
6,336,386 B1 * 1/2002 Lee ..... 81/328

* cited by examiner

*Primary Examiner*—Allen Ostrager
*Assistant Examiner*—Jimmy T Nguyen
(74) *Attorney, Agent, or Firm*—Charles E. Baxley

(57) ABSTRACT

A clip is constructed to include two pivoted clip elements, a torsional spring provided between the clip elements and adapted to hold the clip elements in the open position, a toothed rod member and a pres control structure provided inside the clip elements and adapted to lock the clip elements in the close position to hold down the workpiece.

18 Claims, 5 Drawing Sheets

STRUCTURE OF CLIP

BACKGROUND OF THE INVENTION

1. Field of the Invention

The present invention relates to a clip and, more particularly, to an orthopedically engineered clip that has means to lock the clip element when holding down the workpiece.

2. Description of the Related Art

FIG. 1 illustrates a clip according to the prior art. The clip comprises two pivoted clip elements, a torsional spring adapted to hold the clip elements in the close position. The spring power of the torsional spring determines the gripping force of the clip. When opening the clip, the user must employ much effort to the handheld portions of the clip elements against the spring power of the torsional spring. Further, when the torsional spring starts to wear, the clamping force of the clip is reduced, unable to hold down the workpiece positively. FIG. 2 illustrates another structure of clip according to the prior art. According to this design, the clip comprises two pivoted clip elements, a torsional spring adapted to hold the clip elements in the close position, a big gear wheel provided at the connection area between the clip elements, a lever pivoted to one clip element, a small gear wheel pivoted to one end of the lever and meshed with the big gear wheel. When pulling the lever outwards, the small gear wheel is rotated counter-clockwise to move the big gear wheel and to widen the open status of the handheld portions of the clip elements, increasing the gripping force of the claw end portions of the clip elements. However, it is inconvenient to operate the lever when holding the handheld portions of the clip elements with the hand. Further, the lever may be forced inwards accidentally, causing the workpiece to fall from the claw end portions of the clip elements.

SUMMARY OF THE INVENTION

The present invention has been accomplished under the circumstances in view. It is one object of the present invention to provide a clip, which is orthopedically engineered, convenient for operation. It is another object of the present invention to provide a clip, which can easily be operated to clamp the workpiece with less effort. It is still another object of the present invention to provide a clip, which can be locked when holding down the workpiece. To achieve these and other objects of the present invention, the clip comprises a first clip element, the first clip element comprising a front claw end portion, a rear handheld portion, and a hollow middle coupling portion connected between the claw end portion and the handheld portion of the first clip element; a second clip element, the second clip element comprising a front claw end portion, a rear handheld portion, and a hollow middle coupling portion connected between the claw end portion and the handheld portion of the second clip element and pivoted to the middle coupling portion of the first clip element by a pivot; a torsional spring mounted on the pivot connected between the middle coupling portions of the first clip element and the second clip element and adapted to force the handheld portions of the first clip element and the second clip element apart, the torsional spring having two opposite ends respectively stopped at an inside wall of the handheld portion of the first clip element and an inside wall of the handheld portion of the second clip element; a toothed rod member, the toothed rod member having a first end pivoted to the inside of the middle coupling portion of the first clip element and a second end inserted into the handheld portion of the second clip element; and a press control structure, the press control structure comprising a ratchet block mounted in the handheld portion of the second clip element, the ratchet block having a toothed face adapted for engaging the toothed rod member, and a button adapted for controlling horizontal movement of the ratchet block relative to the toothed rod member between a first position where the ratchet block is engaged with the toothed rod member to stop the clip elements from opening, and a second position where the ratchet block is disengaged from the toothed rod member for enabling the clip elements to be opened.

DETAILED DESCRIPTION OF THE PREFERRED EMBODIMENT

Figure 1:
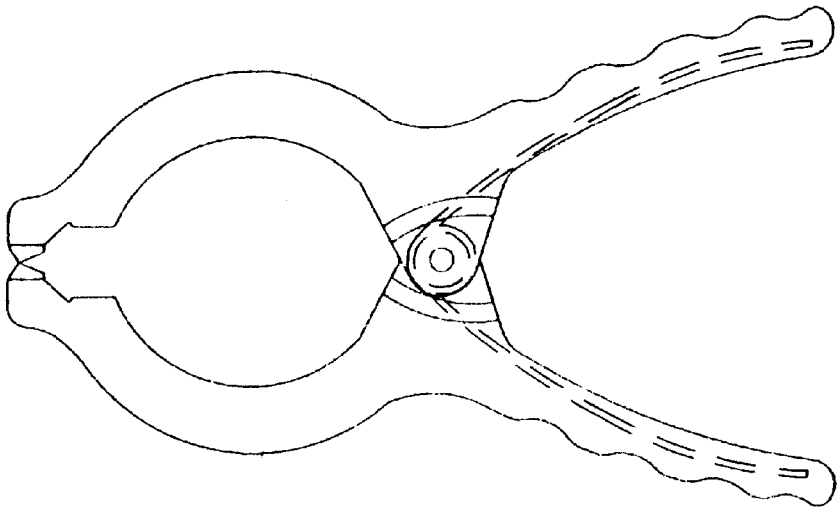
FIG. 1 PRIOR ART
FIG. 1 is a plain view of a clip according to the prior art.
Figure 2:
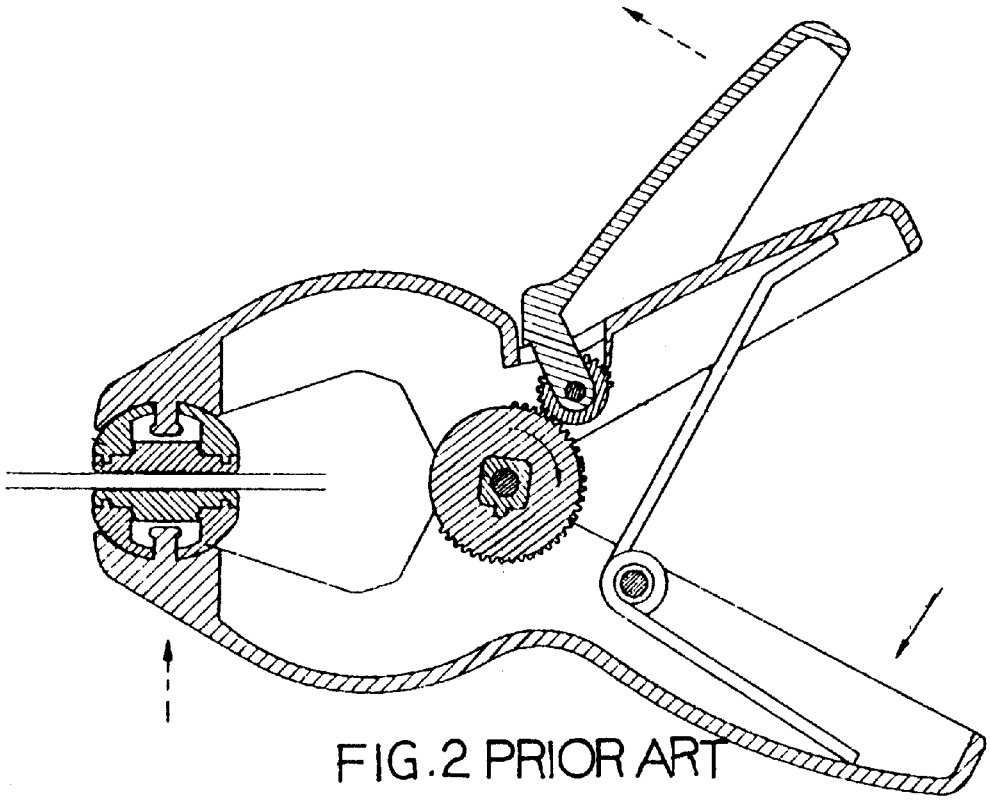
FIG. 2 PRIOR ART
FIG. 2 is a sectional view of another structure of clip according to the prior art.
Figure 3:
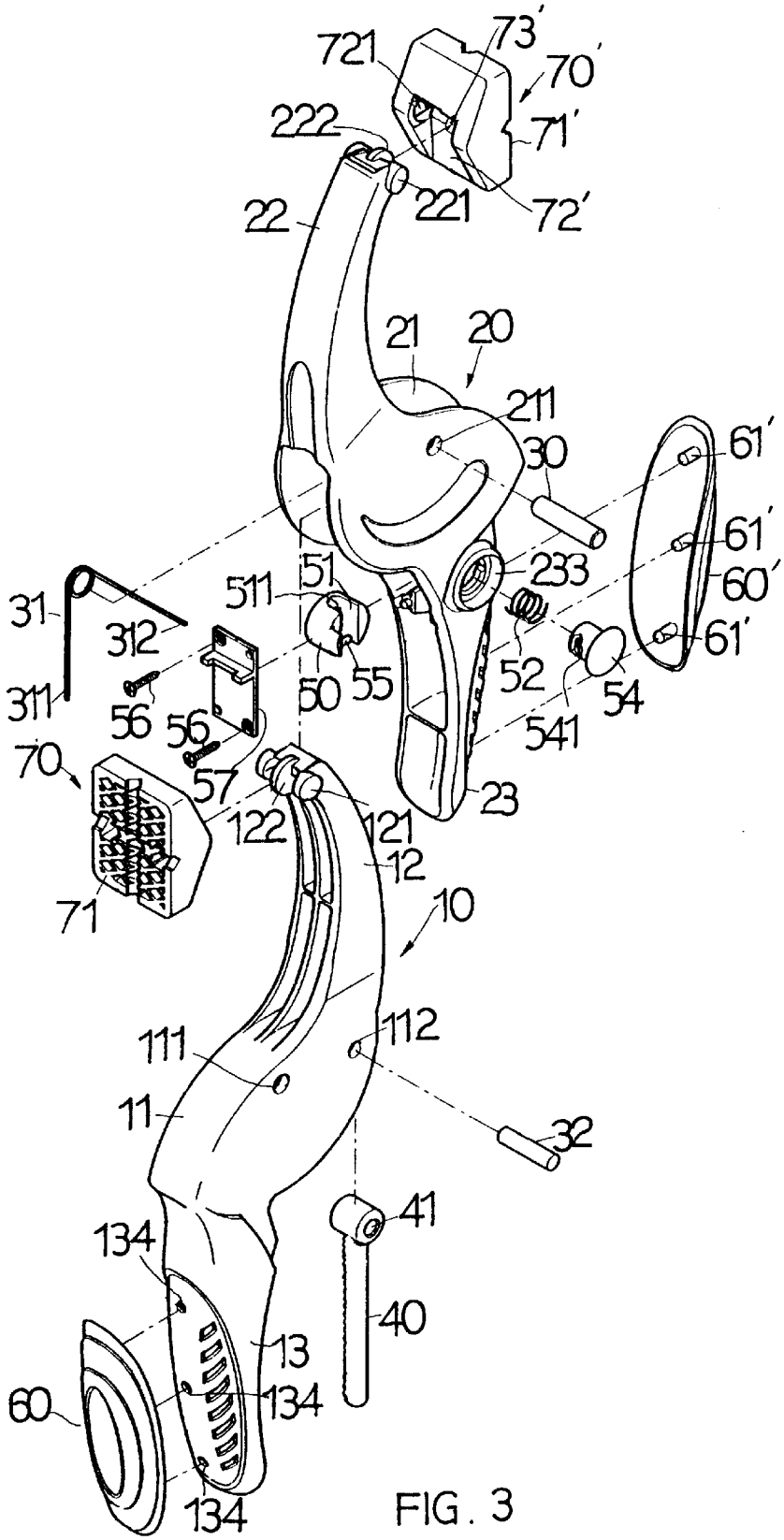
FIG. 3 is an exploded view of a clip according to the present invention.
Figure 4:
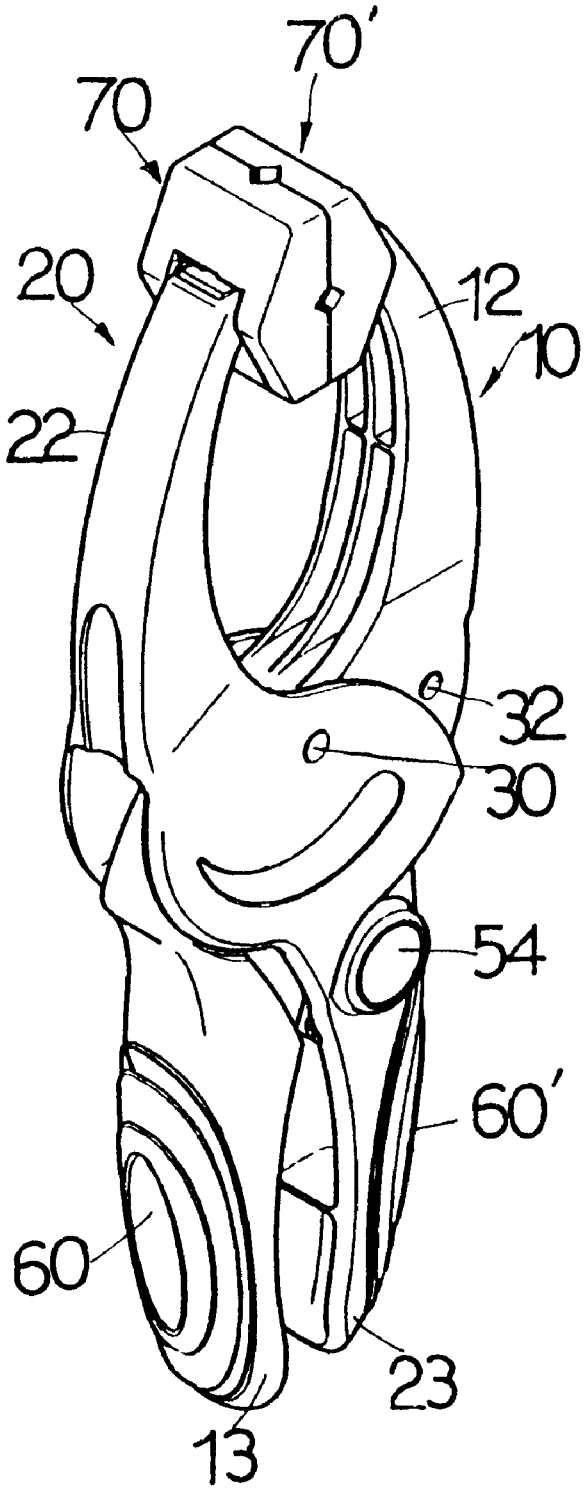
FIG. 4 is an elevational assembly view of the clip according to the present invention.

Referring to FIGS. 3 and 4, a clip is shown comprised of a first clip element 10, and a second clip element 20. The clip elements 10;20 each comprise a hollow middle coupling portion 11 or 21, a smoothly arched claw end portion 12 or 22 forwardly extended from one end of the coupling portion 11 or 21, a handheld portion 13 or 23 backwardly extended from the other end of the coupling portion 11 or 21. The coupling portions 11;21 of the clip elements 10;20 have two pivot holes 111 aligned at two sides. A pivot pin 30 is inserted into the pivot holes 111;211 to pivotally connect the clip elements 10;20 together. A torsional spring 31 is mounted on the pivot pin 30 inside the coupling portions 11;21, having two opposite ends 311;312 respectively stopped at the inside wall of the handheld portions 13;23 to hold the clip in the open status.

A toothed rod member 40 is provided inside the clip elements 10;20. The toothed rod member 40 has an eyelet head 41. The coupling portion 11 of the first clip element 10 further comprises two pivot holes 112. A pivot pin 32 is press-fitted into the pivot holes 112 and inserted through the eyelet head 41 of the toothed rod member 40 to hold the toothed rod member 40 inside the coupling portion 11 of the first clip element 10, enabling the toothed rod body of the toothed rod member 40 to be extended downwards and inserted into the handheld portion 23 of the second clip element 20.

Figure 7:
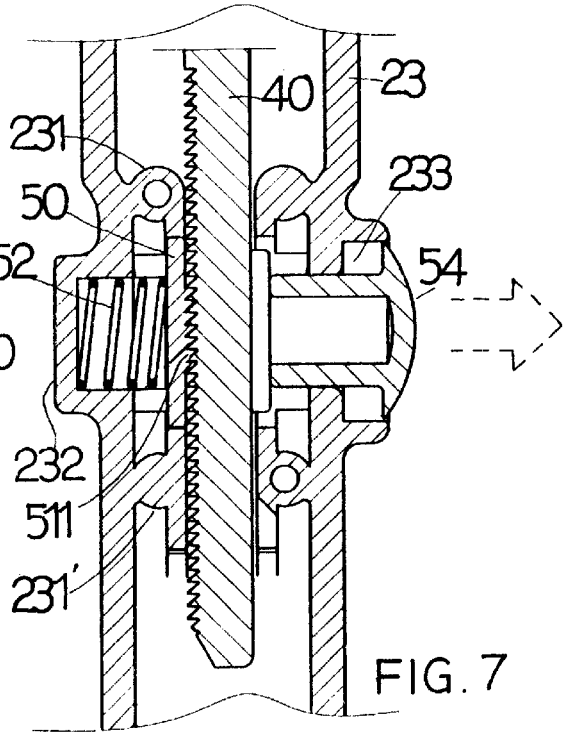
FIG. 7 is a sectional view in an enlarged scale taken along line 7—7 of FIG. 5.
Figure 10:
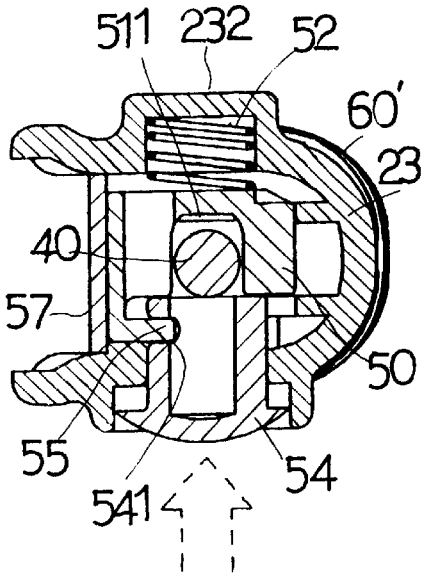
FIG. 10 is a sectional view in an enlarged scale taken along line 10—10 of FIG. 6.
Figure 9:
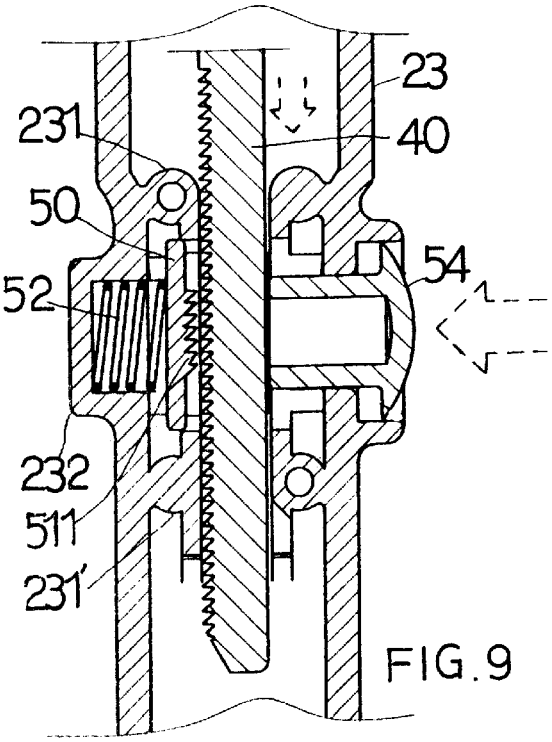
FIG. 9 is a sectional view in an enlarged scale taken along line 9—9 of FIG. 6.

A press control structure is provided in the clip elements 10;20. The press control structure comprises two stop walls 231;231' integral with the inside wall of the handheld portion 23 of the second clip element 20 at different elevations corresponding to the toothed rod member 40 (see FIGS. 7 and 9), a ratchet block 50 inserted in between the top walls 231;231', the ratchet block 50 having an opening 51 for the passing of the toothed rod member 40 and a toothed face 511 disposed in the opening 51 and meshed with the toothed rod body of the toothed rod member 40, a compression spring 52 mounted in a recessed inside hole 232 of the handheld portion 23 and stopped against the back side of the ratchet block 50, a button hole 233 in one sidewall of the handheld portion 23 opposite to the ratchet block 50, a button 54 installed in the button hole 233 and stopped at the front side of the ratchet block 50. Further, coupling means is provided to coupling the button 54 to the ratchet block 50. The coupling means comprises a coupling hole 541 provided in the button 54, and a coupling rod 55 extended from the front side of the ratchet block 50 and adapted for engaging into the coupling hole 541. Normally, the spring power of the spring 52 forces the toothed face 511 of the ratchet block 50 into engagement with the toothed rod body of the toothed rod member 40. When the user pressed the button 54, the ratchet block 50 is forced backwards against the spring 50 to disengage the toothed face 511 from the toothed rod body of the toothed rod member 40. A sealing plate 57 is fixedly fastened to the handheld portion 23 of the second clip element 20 by screws 56 to stop the ratchet block 50 from falling out of the second clip element 20.

Two flexible grips 60;60' are respectively provided at the handheld portions 13;23 of the clip elements 10;20. The grips 60;60' are shaped like a smoothly arched pad, each having a plurality of mounting pins 61;61' perpendicularly extended from the respective inside wall and respectively press-fitted into respective pin holes 134;134' in the handheld portions 13;23 of the clip elements 10;20.

Two jaw plates 70;70' are respectively provided at the smoothly arched claw end portions 12;22 of the clip elements 10;20. The jaw plates 70;70' each comprise an embossed front clamping face 71 or 71', a back open chamber 72 or 72', two recessed round holes 721 bilaterally disposed inside the back open chamber 72 or 72', and a smoothly arched groove 73 or 73' disposed in the bottom wall of the back open chamber 72 or 72' and equally spaced between the recessed round holes 721. The smoothly arched claw end portions 12;22 each comprise two rounded pegs 121 or 221 disposed at two sides and respectively pivotally coupled to the recessed round holes 721 (the rounded pegs 121 or 221 can easily be fastened to the recessed round holes 721 by means of the application of a mechanical apparatus), and a smoothly arched projection 122 or 222 respectively inserted into the smoothly arched groove 73 or 73' to guide movement of the respective jaw plate 70 or 70' relative to the respective clip element 10 or 20.

Figure 6:
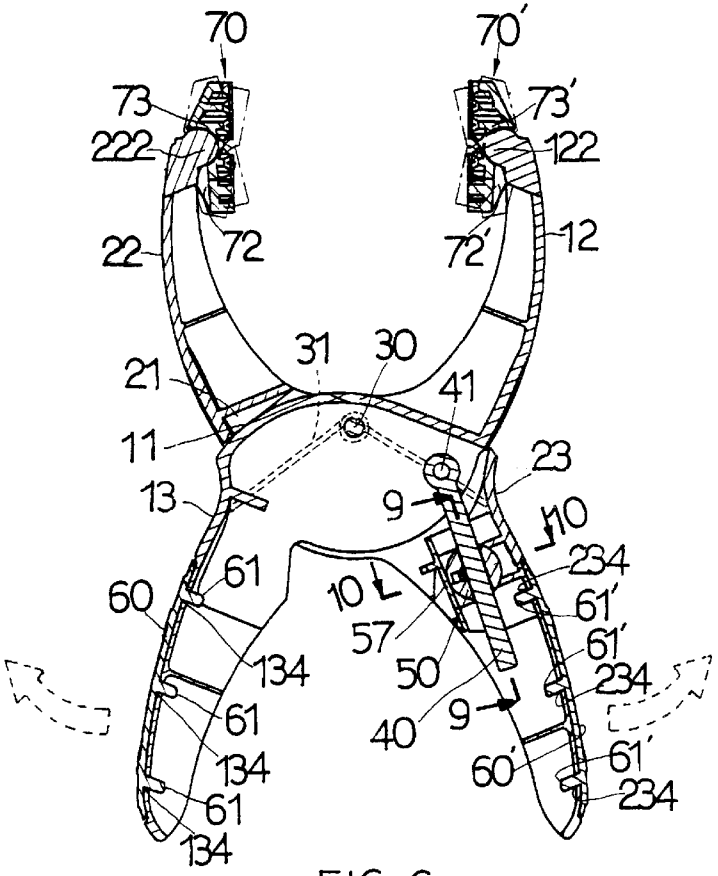
FIG. 6 is a schematic sectional view of the present invention, showing the clip opened.
Figure 5:
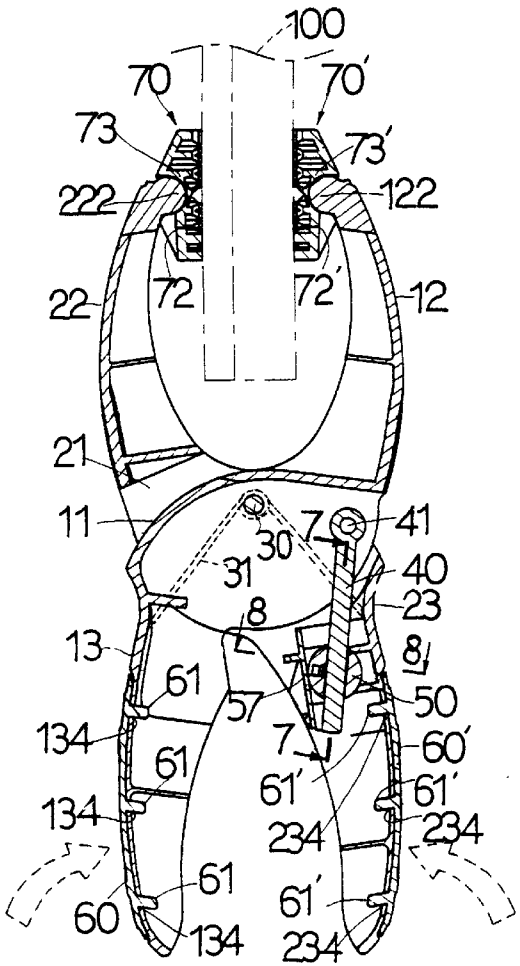
FIG. 5 is a schematic sectional view of the present invention, showing the jaw plates of the clip clamped on the workpiece.
Figure 8:
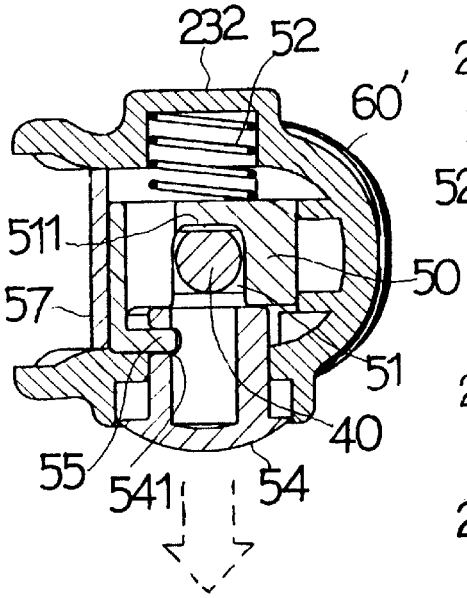
FIG. 8 is a sectional view in an enlarged scale taken along line 8—8 of FIG. 5.

Referring to FIGS. 5 and 6, when the user gripped the handheld portions 13;23 to compress the torsional spring 31, the jaw plates 70'70' are forced against each other to hold down the workpiece 100 between. At the same time, the toothed rod member 40 is lifted with the change of the angle of the handheld portion 13 of the first clip element 10 over the ratchet block 50. When gripped tight, the spring power of the spring 52 forces the toothed face 511 of the ratchet block 50 into engagement with the toothed rod body of the toothed rod member 40 to stop the toothed rod member 40 from downward movement, and therefore the clip is locked and, the workpiece 100 is firmly held in between the jaw plates 70;70'. When releasing the workpiece 100, press the button 54 to disengage the ratchet block 50 from the toothed rod member 40, enabling the spring power of the spring 31 to force the handheld portions 13;23 of the clip elements 10;20 apart.

While only one embodiment of the present invention has been shown and described, it will be understood that various modifications and changes could be made thereunto without departing from the spirit and scope of the invention disclosed.

What the invention claimed is:

1. A clip comprising:

a first clip element, said first clip element comprising a front claw end portion, a rear handheld portion, and a hollow middle coupling portion connected between the claw end portion and the handheld portion of said first clip element;

a second clip element, said second clip element comprising a front claw end portion, a rear handheld portion, and a hollow middle coupling portion connected between the claw end portion and the handheld portion of said second clip element and pivoted to the middle coupling portion of said first clip element by a pivot;

a torsional spring mounted on the pivot connected between the middle coupling portions of said first clip element and said second clip element and adapted to force the handheld portions of said first clip element and said second clip element apart, said torsional spring having two opposite ends respectively stopped at an inside wall of the handheld portion of said first clip element and an inside wall of the handheld portion of said second clip element;

a toothed rod member, said toothed rod member having a first end pivoted to the inside of the middle coupling portion of said first clip element and a second end inserted into the handheld portion of said second clip element; and a press control structure, said press control structure comprising a ratchet block mounted in the handheld portion of said second clip element, said ratchet block having a toothed face adapted for engaging said toothed rod member, and a button adapted for controlling horizontal movement of said ratchet block relative to said toothed rod member.

2. The clip as claimed in claim 1, wherein said toothed rod member has an eyelet head provided at said first end and pivoted to a pivot pin inside the middle coupling portion of said first clip element.

3. The clip as claimed in claim 1, wherein said ratchet block has a rear side provided with a compression spring supported on one sidewall of the handheld portion of said second clip element and a front side coupled to said button; said button has an inner side coupled to the front side of said ratchet block and an outer side extended out of the handheld portion of said second clip element.

4. The clip as claimed in claim 3, wherein said ratchet block comprises an opening in the front side thereof for the passing of said toothed rod member, and said toothed face is disposed inside the opening.

5. The clip as claimed in claim 4, wherein said compression spring forces said toothed face of said ratchet block into engagement with said toothed rod member.

6. The clip as claimed in claim 5, wherein said toothed face of said ratchet block is so made that said toothed rod member is moved over said toothed face of said ratchet block upwards when the handheld portions of said first clip element and said second clip element are moved toward each other.

7. The clip as claimed in claim 6, wherein said toothed face of said ratchet block is so made that said toothed face of said ratchet block stops said toothed rod member from moving over said toothed face of said ratchet block downwards.

8. The clip as claimed in claim 7, wherein said button forces said ratchet block backwards to compress said compression spring and to disengage said toothed face from said toothed rod member when depressed by the user.

9. The clip as claimed in claim 8, wherein the handheld portions of said clip elements are moved apart to open the claw end portions of said clip elements when said ratchet block is disengaged from said toothed rod member.

10. The clip as claimed in claim 3, wherein said press control structure further comprises coupling means that connects said button to said ratchet block.

11. The clip as claimed in claim 10, wherein said coupling means comprises a coupling hole disposed in the inner side of said button, and a coupling rod extended from the front side of said ratchet block and engaged into said coupling hole.

12. The clip as claimed in claim 1, further comprising two flexible grips respectively fastened to the handheld portions of said first clip element and said second clip element.

13. The clip as claimed in claim 12, wherein said grips each have an inside wall and a plurality of mounting pins perpendicularly extended from the inside wall; said first clip element and said second clip element each have a plurality of pin holes adapted for receiving the mounting pins of said grips.

14. The clip as claimed in claim 1, further comprising two jaw plates respectively connected to the claw end portions of said first clip element and said second clip element.

15. The clip as claimed in claim 14, wherein said jaw plates each have an embossed front clamping face, and a rear side respectively connected to the claw end portions of said first clip element and said second clip element.

16. The clip as claimed in claim 15, wherein said jaw plates are respectively pivoted to said claw end portions of said first clip element and said second clip element for turning relative to said first clip element and said second clip element within a limited tilting angle.

17. The clip as claimed in claim 16, wherein said jaw plates each comprise a back open chamber, and two recessed round holes bilaterally disposed inside said back open chamber; the claw end portions of said first clip element and said second clip element each comprise two rounded pegs disposed at two sides and respectively pivotally coupled to the recessed round holes of said jaw plates.

18. The clip as claimed in claim 17, wherein said jaw plates each further comprise a smoothly arched groove disposed in a bottom wall of the respective back open chamber and equally spaced between the respective recessed round holes; the claw end portions of said first clip element and said second clip element each further comprise a smoothly arched projection respectively inserted into the smoothly arched grooves of said jaw plates and adapted for guiding tilting motion of said jaw plates relative to said first clip element and said second clip element.

* * * * *